US008292249B2

(12) United States Patent
Chiu

(10) Patent No.: US 8,292,249 B2
(45) Date of Patent: Oct. 23, 2012

(54) FOLDABLE TOOL STAND

(75) Inventor: Cheng-Hung Chiu, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 133 days.

(21) Appl. No.: 12/787,544

(22) Filed: May 26, 2010

(65) Prior Publication Data

US 2010/0301180 A1 Dec. 2, 2010

Related U.S. Application Data

(60) Provisional application No. 61/181,368, filed on May 27, 2009.

(30) Foreign Application Priority Data

May 27, 2009 (TW) ..... 98117732 A

(51) Int. Cl.
*A47G 23/02* (2006.01)

(52) U.S. Cl. ..... 248/434; 248/440; 248/185.1; 248/168; 108/115; 269/901

(58) Field of Classification Search ..... 248/127, 248/146, 185.1, 166, 168–171, 434, 435, 248/440; 108/115, 118, 121–123; 269/901
See application file for complete search history.

(56) References Cited

U.S. PATENT DOCUMENTS

| | | | | | |
|---|---|---|---|---|---|
| 287,739 | A * | 10/1883 | Tull | 108/171 |
| 3,988,021 | A * | 10/1976 | Grover | 473/15 |
| 4,262,606 | A * | 4/1981 | Hodson | 108/99 |
| 4,643,103 | A * | 2/1987 | Jorgensen | 108/36 |
| 5,887,531 | A * | 3/1999 | Covill | 108/174 |
| 6,722,618 | B1 * | 4/2004 | Wu | 248/166 |
| 7,243,896 | B2 * | 7/2007 | Zhang | 248/676 |
| 7,287,730 | B1 * | 10/2007 | Chen | 248/150 |
| 7,757,999 | B2 * | 7/2010 | Zhang | 248/166 |

* cited by examiner

*Primary Examiner* — Terrell McKinnon
*Assistant Examiner* — Steven Marsh
(74) *Attorney, Agent, or Firm* — Bacon & Thomas, PLLC

(57) ABSTRACT

A foldable tool stand includes a main shaft, a pair of base plates affixed to the main shaft and two pairs of legs. The main shaft has a first end, a second end, and positioning members respectively provided at the first end and the second end for securing a machine tool. The legs are movable from an extended supporting position to support the stand on the floor to a collapsed position where the legs are closely aligned along the main shaft. By means of utilizing the foldable characteristic of the legs, the foldable tool stand and the machine tool carried on the foldable tool stand provide significant benefits because of its high mobility.

13 Claims, 12 Drawing Sheets

FOLDABLE TOOL STAND

This application is a non-provisional application claiming the benefit from U.S. Provisional Application Ser. No. 61/181,368, filed on May 27, 2009, and Taiwanese Application No. TW 098117732 filed on May 27, 2009.

FIELD OF THE INVENTION

The present invention relates to a tool stand for supporting a machine tool thereon and more particularly, to a foldable tool stand.

To facilitate mobility of a small machine tool (for example, a table saw, miter saw, band saw), the stand for the machine tool may be designed as a foldable stand, enabling the machine tool to be moved to and used in a variety of different workplaces.

Taiwan Patent No. TW M283108 discloses a stand, which comprises a plurality of legs that are detachably mounted to the bottom side of a support member. However, in order to move the stand to an alternate location, the user must remove the machine tool from the support member of the stand and detach the legs from the support member. The user must then carry all the parts to the new location and re-install the disassembled parts and reattach the machine tool to the support member and stand. Thus, the time and effort required to mount and dismount the stand is extensive.

Additionally, U.S. Pat. No. 6,607,015 discloses a foldable worktable which has two U-shaped legs pivotally attached to the bottom of the tabletop thereof. This design for a foldable worktable is collapsible, however it has a large volume even when collapsed, which does not facilitate carrying and storage.

SUMMARY

The present disclosure of a foldable tool stand provides advantages solutions to the above discussed drawbacks of previous foldable stands. In particular, a foldable tool stand is provided, which can be set between a collapsed position for carrying and an extended position for use and, which further has a small volume when collapsed.

An exemplary embodiment of a foldable stand includes a main shaft, a pair of base plates affixed to the main shaft, and two pairs of legs. The main shaft has a first end, a second end opposed to the first end, and a positioning member located on each of the first and second ends for holding a machine tool. The base plates are respectively affixed to the first and second ends of the main shaft. Each leg has a connection end and a stop end opposed to the connection end. When the legs are set in an extended standing position, the connection ends are respectively connected to the base plates, and the stop ends are respectively engaged with a supporting surface, such as the floor. When the legs are moved to a collapsed position, they are closely aligned along the main shaft.

In another exemplary embodiment of the present disclosure, the foldable tool stand includes a main shaft, a pair of base plates affixed to the main shaft, two pairs of legs and at least one pair of support bars. Each main shaft has a first end, a second end opposed to the first end, and a positioning member arranged on each of the first and second ends for supporting a machine tool. The base plates are respectively affixed to the first and second ends of the main shaft. Each leg has a connection end and a stop end opposed to the connection end. When the legs are moved to an extended standing position, the connection ends are respectively connected to the base plates, and the stop ends are respectively maintained spaced away from the main shaft. When the legs are moved to a collapsed position, they are closely aligned along the main shaft. The support bars are respectively connected between the base plates and the positioning members, each having a fixed end and a distal end opposed to the fixed end for the mounting of one respective positioning member. The support bars are movable between an extended standing position where the fixed ends are respectively connected to the base plates and the distal ends are maintained spaced away from the main shaft, and a collapsed position where the support bars are closely attached to the main shaft.

The foldable tool stand according to the present disclosure has the advantages that the positioning members are used for supporting a machine tool; the legs can be moved between the extended standing position for use and the collapsed position for movement and delivery; and the collapsed foldable tool stand has a small volume, facilitating delivery and storage.

DETAILED DESCRIPTION

Figure 1:
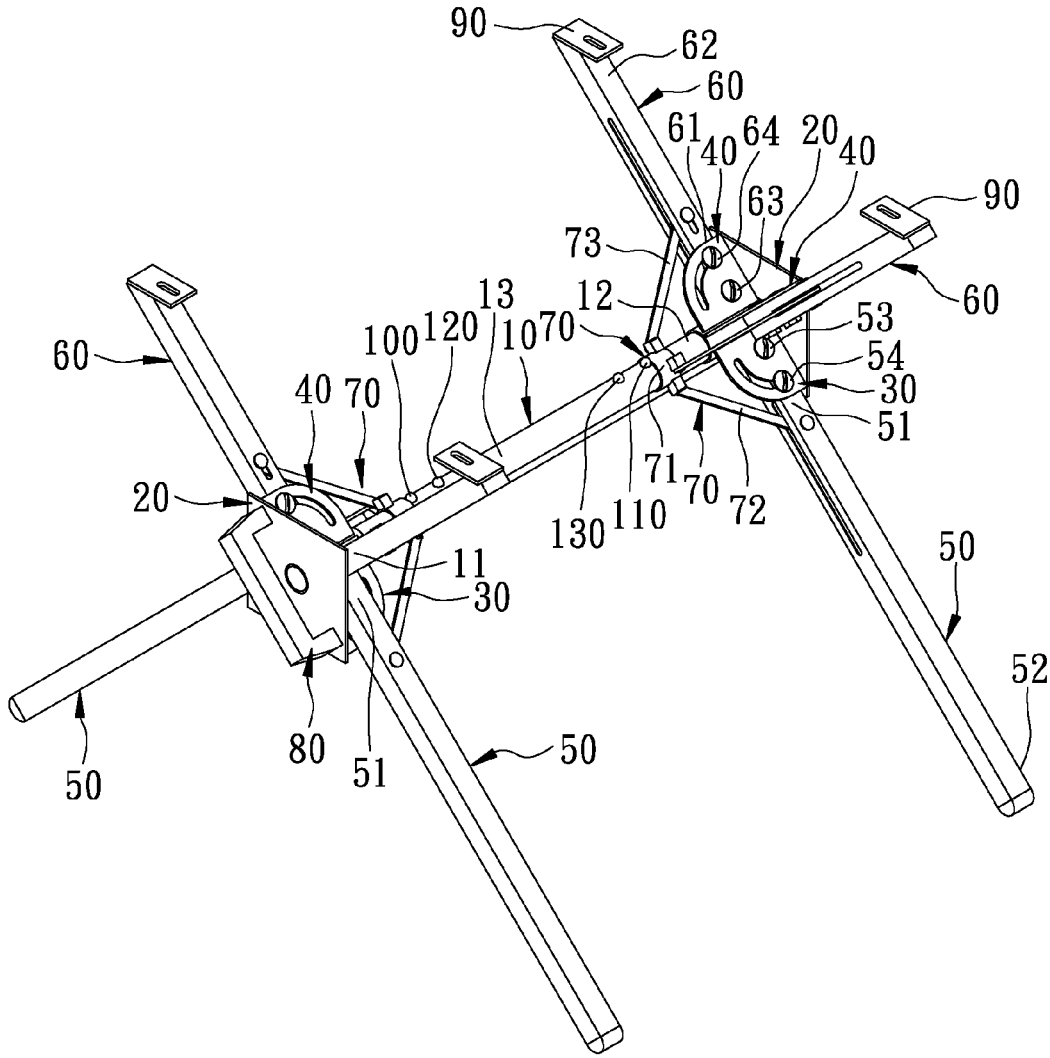
FIG. 1 is an elevational assembly view of a foldable stand in accordance with a first embodiment of the present disclosure.
Figure 2:
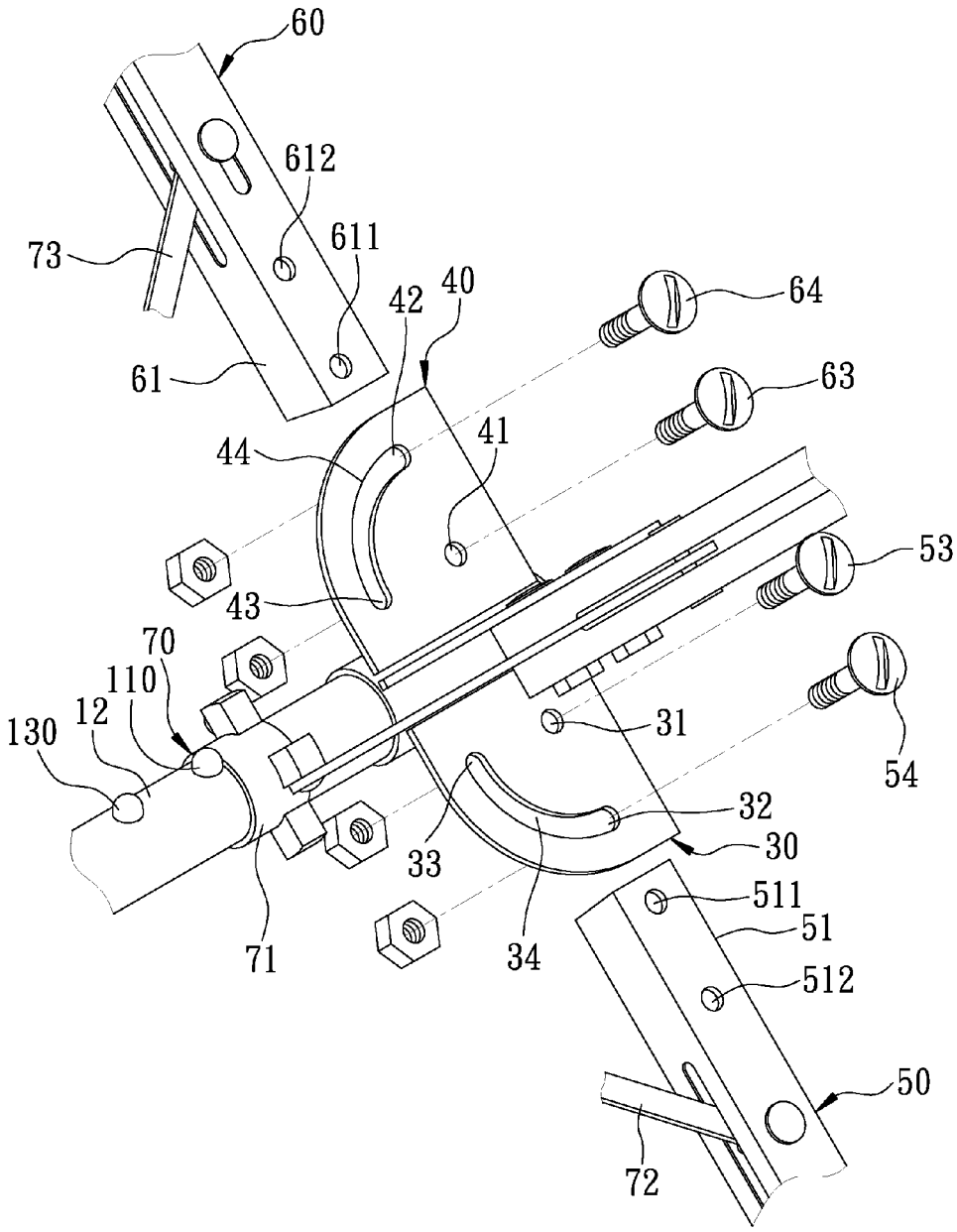
FIG. 2 is an exploded view of a part of the foldable stand shown in FIG. 1, showing the relationship between the leg and support bar and the associated first and second pivot plates at one end of the main shaft.
Figure 3:
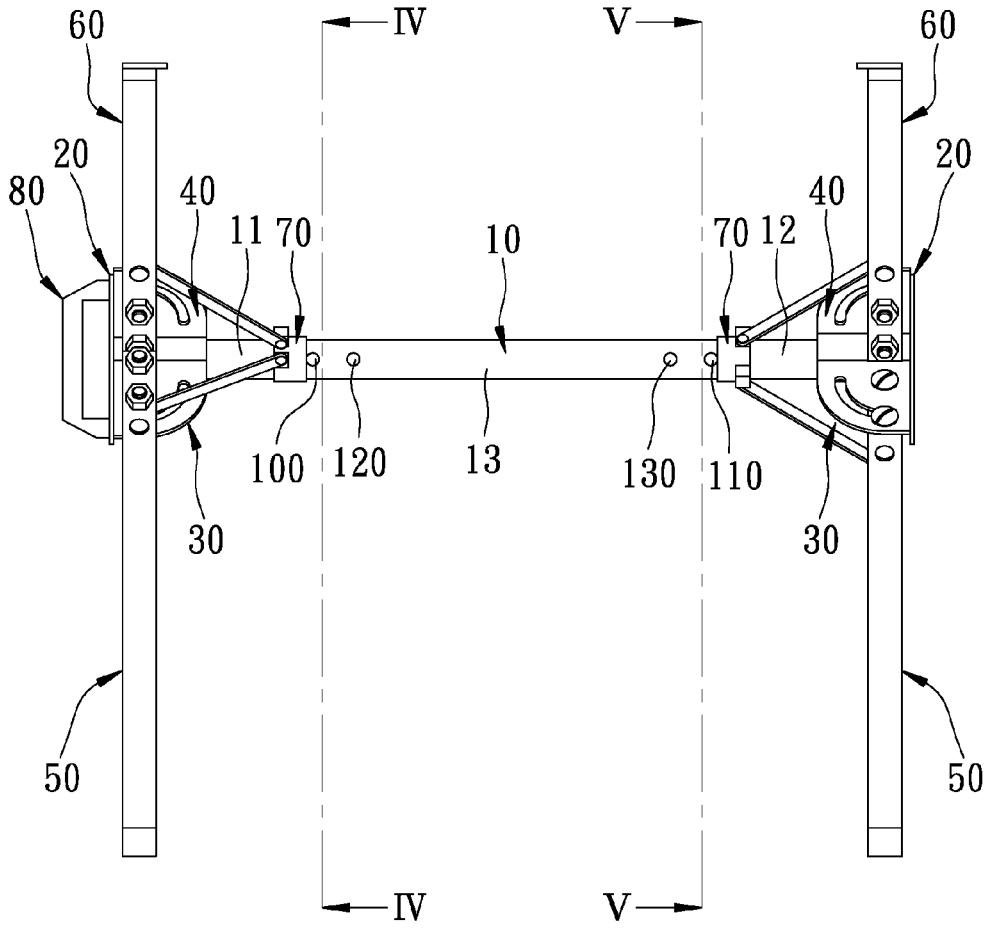
FIG. 3 is a front view of the foldable stand shown in FIG. 1, showing the legs and support bars extended out from the main shaft in the operative, supporting configuration.

A first embodiment of a foldable tool stand according to the present disclosure is shown in FIGS. 1-3. As seen in FIG. 1, a foldable tool stand generally includes a main shaft 10, a pair of base plates 20 affixed to the main shaft 10, two pairs of first pivot plates 30 and two pairs of second pivot plates 40 respectively mounted on the base plates 20. Two pairs of legs 50 are respectively pivotally connected to the first pivot plates 30 and two pairs of support bars 60 are respectively pivotally connected to the second pivot plates 40. A pair of linkages 70 are respectively coupled between the main shaft 10 and the legs 50 and support bars 60 A carrying handle 80 is also provided on one of the base plates 20. The foldable tool stand is adapted for holding a small machine tool, for example, a table saw (not shown).

The main shaft 10 is a bar, which, while shown to be round, may have any suitable shape. The main shaft 10 has a first end 11, a second end 12 opposite to the first end 11 and a middle part 13 connected between the first end 11 and the second end 12. A first locating pin 100 and a second locating pin 110 are respectively mounted at the first end 11 and second end 12 of the main shaft 10. A third locating pin 120 and a fourth locating pin 130 are respectively mounted at the main shaft 10 between the first locating pin 100 or second locating pin 110 and the middle part 13. The first locating pin 100, the second locating pin 110, the third locating pin 120 and the fourth locating pin 130 are biased or spring-loaded pins able to return to a former position after being pressed toward the inside of the main shaft 10.

The base plates 20 are rectangular plate members perpendicularly affixed to the first end 11 and second end 12 of the main shaft 10, respectively. Of course, the base plates 20 may have any suitable shape, such as, for example, circular or rectangular.

The first pivot plates 30 are respectively affixed to the base plates 20 at one side relative to the first end 11 and second end 12 of the main shaft 10. Each first pivot plate 30 has a pivot portion 31 disposed adjacent to the main shaft 10, a first positioning portion 32 disposed at one side relative to the pivot portion 31, a second positioning portion 33 disposed at another side relative to the pivot portion 31 and adjacent to the main shaft 10, and a guide slot 34 connected between the first positioning portion 32 and the second positioning portion 33. The guide slot 34 is configured in a quarter arc shape based on the center of rotation at the pivot portion 31.

The second pivot plates 40 are respectively affixed to the base plates 20 at the other, opposite side relative to the first end 11 and second end 12 of the main shaft 10. Each second pivot plate 40 has a pivot portion 41 disposed adjacent to the main shaft 10, a first positioning portion 42 disposed at one side relative to the pivot portion 41, a second positioning portion 43 disposed at another side relative to the pivot portion 41 and adjacent to the main shaft 10, and a guide slot 44 connected between the first positioning portion 42 and the second positioning portion 43. The guide slot 44 is configured in a quarter arc shape based on the center of rotation at the pivot portion 41.

The legs 50 each have a connection end 51 and a stop end 52 opposite to the connection end 51. The exploded view in FIG. 2 shows the connection end 51 having a first rotation portion 511 and a first locating portion 512 disposed at an inner side relative to the first rotation portion 511. The connection end 51 is provided with a first fastening member 53, which is adapted for pivotally fastening the first rotation portion 511 to the pivot portion 31 of the first pivot plate 30 or to base plates 20. The connection end 51 also has a second fastening member 54, which is insertable through the guide slot 34 and fastenable to the first locating portion 512 for sliding along the guide slot 34 between the first positioning portion 32 and the second positioning portion 33.

Two pairs of support bars 60 are respectively connected between base plates 20 and the positioning members. The support bars 60 each have a fixed end 61 and a distal end 62 opposite to the fixed end 61. The first end 61 has a second rotation portion 611 and a second locating portion 612 disposed at an inner side relative to the second rotation portion 611, and is provided with a first fastening member 63, which is adapted for pivotally fastening the second rotation portion 611 to the pivot portion 41 of the second pivot plate 40 or to base plates 20, and a second fastening member 64, which is insertable through the guide slot 44 and fastenable to the second locking portion 612 for sliding along the guide slot 44 between the first positioning portion 42 and the second positioning portion 43. Further, a positioning member 90 is fixedly provided at the distal end 62 of each support bar 60.

The linkages 70 are symmetrically mounted at the first and second ends 11 and 12 of the main shaft 10 Each linkage 70 includes a sleeve 71 arranged around the main shaft 10 and movable along the length of the main shaft 10. A pair of first links 72 is pivotally coupled between the sleeve 71 and the associated legs 50, and a pair of second links 73 is pivotally coupled between the sleeve 71 and the associated support bars 60. When the sleeves 71 of the linkages 70 are moved forwards or backwards along the main shaft 10, the legs 50 and the support bars 60 are synchronously moved toward or apart from the main shaft 10.

The handle 80 may be mounted on the base plate 20 at the first end 11 of the main shaft 10.

Figure 4:
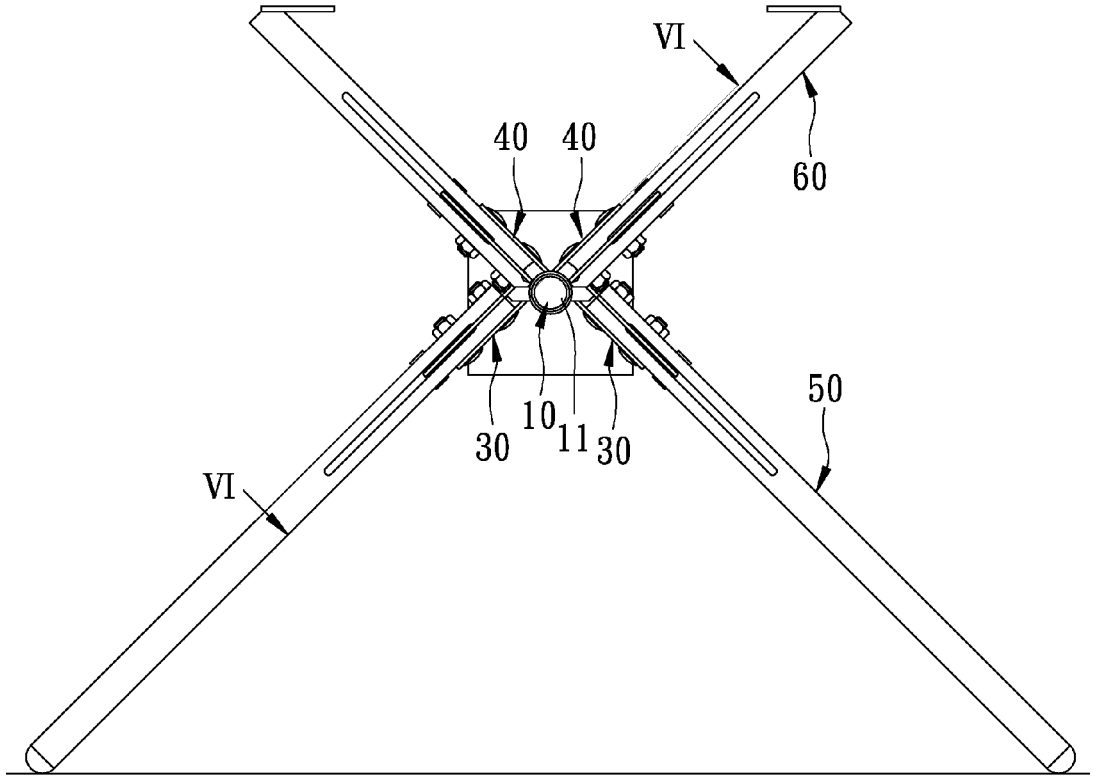
FIG. 4 is a sectional view taken along line IV-IV of FIG. 3.
Figure 5:
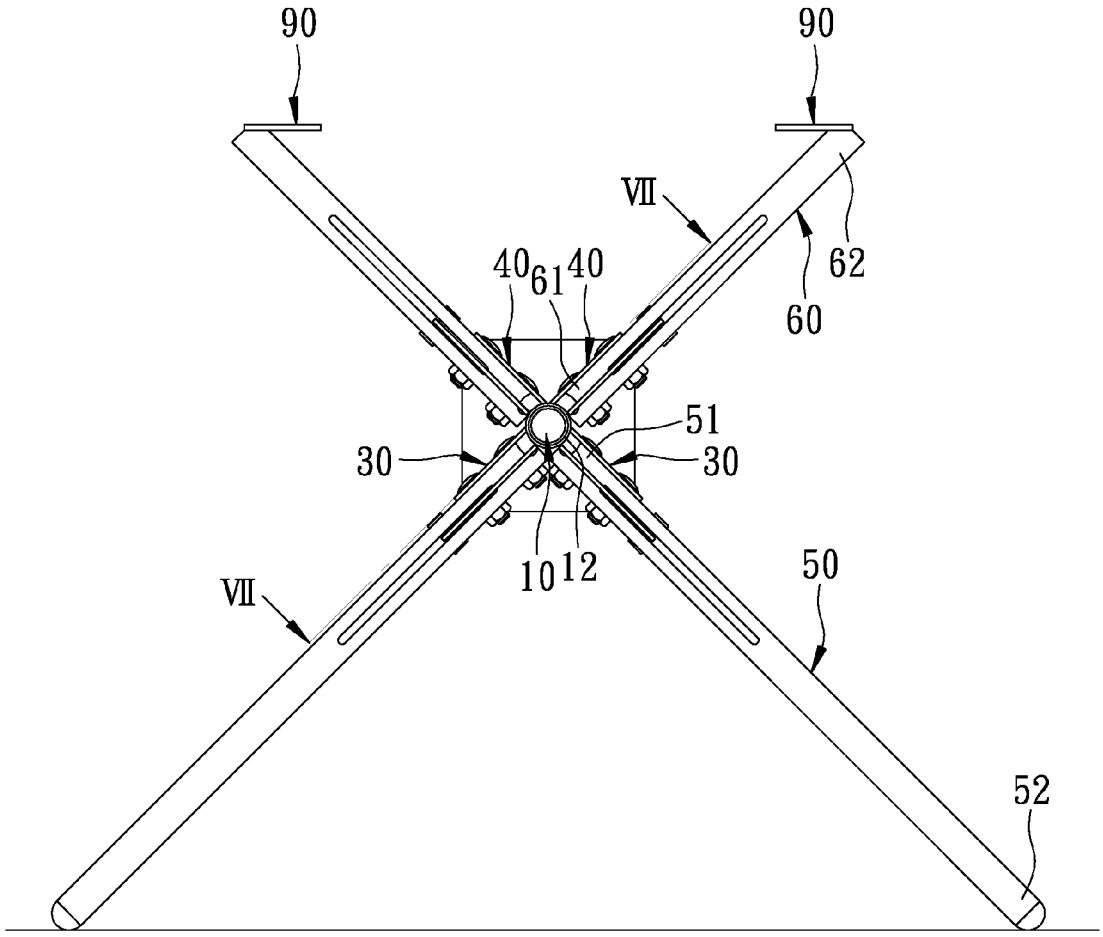
FIG. 5 is a sectional view taken along line V-V of FIG. 3.

As shown in FIGS. 3-5, when the foldable tool stand is assembled and set in the extended supporting position for use, the legs 50 are maintained in a perpendicular manner relative to the first pivot plates 30, the support bars 60 are maintained in a perpendicular manner relative to the second pivot plates 40, and the positioning members 90 are maintained in a horizontal manner at the distal ends 62 of the support bars 60 for supporting a machine tool. Further, the legs 50 corresponding to the first end 11 of the main shaft 10 are disposed at an outer side relative to the first pivot plates 30, as shown in FIG. 4, and the legs 50 corresponding to the second end 12 of the main shaft 10 are disposed at an inner side relative to the first pivot plates 30, as shown in FIG. 5, and therefore the mounting positions of the legs 50 corresponding to the first and second ends 11 and 12 of the main shaft 10 are retained in a staggered configuration.

When the legs 50 are extended, i.e., the legs are in a standing position for supporting the stand, the connection ends 51 of the legs 50 can be connected to the first pivot plates 30 by second fastening members 54, and the stop ends 52 of the legs 50 are perpendicular to the main shaft 10 are spaced from the main shaft 10 to be engaged with a supporting surface, such as the floor. Additionally, when the legs 50 are in the extended supporting position, the support bars 60 are also in the extended position, where the connection ends 61 of the support bars 60 can be connected to the first pivot plate 30 by second fastening members 64, and the distal ends 62 are perpendicular to the main shaft 10 and spaced away from the main shaft. When a machine tool is loaded on the support bars 60, the fixed ends 61 remain connected to the second pivot plates 40, and the distal ends 62 are perpendicular to the main shaft 10. Further, as shown in FIGS. 6 and 7, the first fastening members 53 and 63 pivotally connect the first rotation portions 511 of the connection ends 51 of the legs 50 and the second rotation portions 611 of the fixed ends 61 of the support bars 60 to the pivot portions 31 of the first pivot plates 30 and the pivot portions 41 of the second pivot plates 40 Further, the second fastening members 54 and 64 that are tightly fastened to the first locating portions 512 of the connection ends 51 of the legs 50 and the second locating portions 612 of the fixed ends 61 of the support bars 60 are respectively engaged with the first positioning portions 32 and 42.

Figure 6:
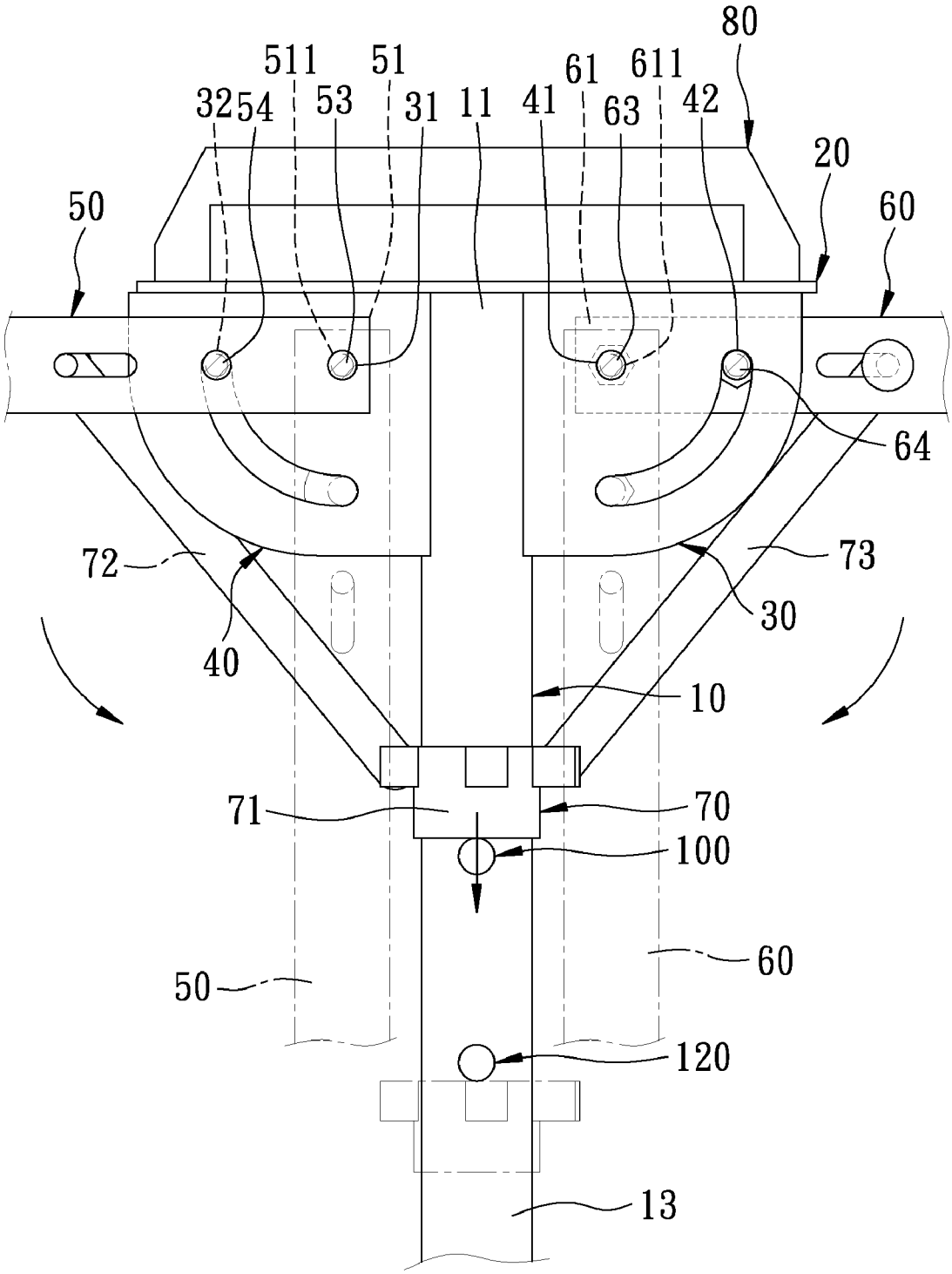
FIG. 6 is a sectional view taken along line VI-VI of FIG. 4.
Figure 7:
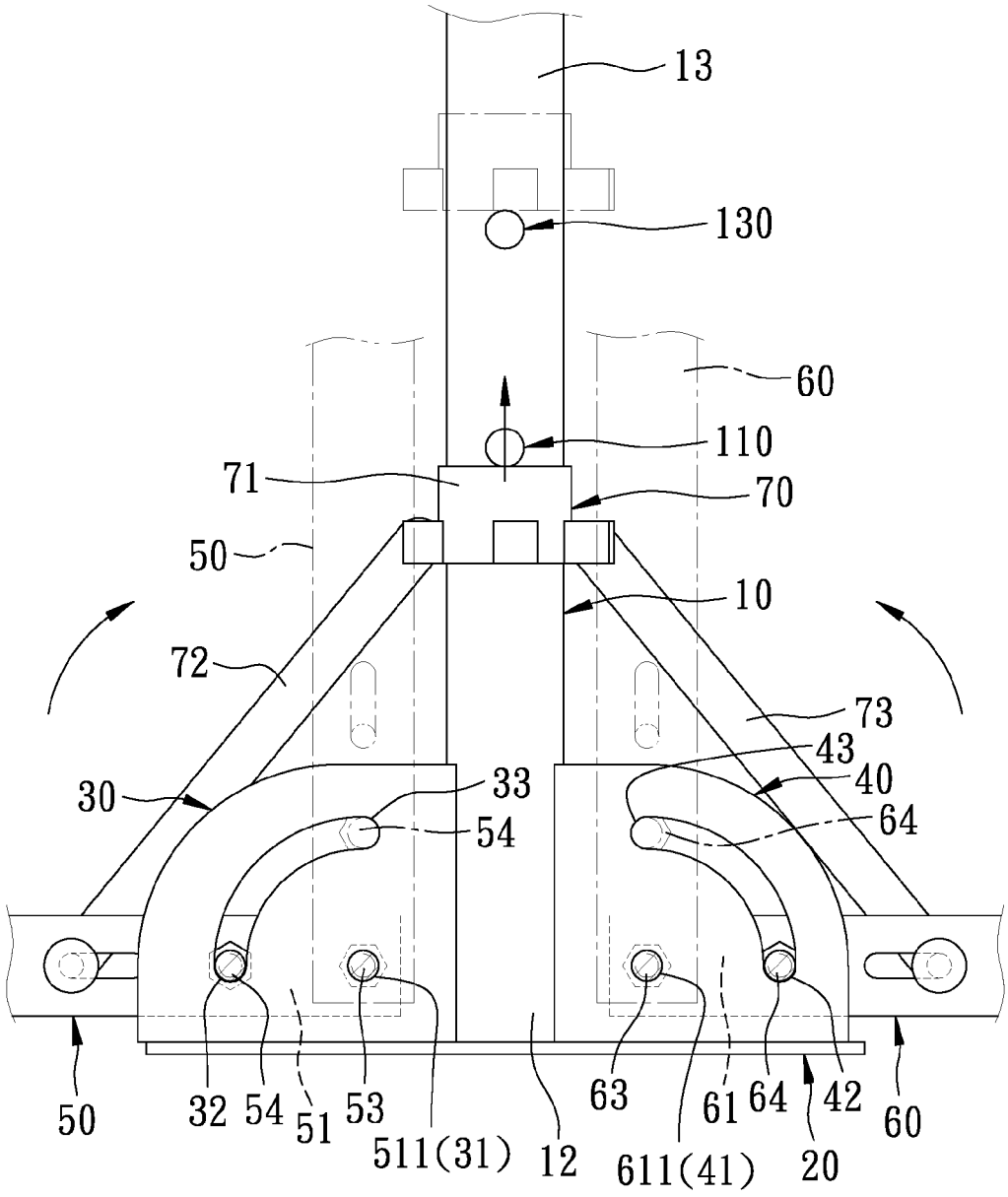
FIG. 7 is a sectional view taken along line VII-VII of FIG. 5.
Figure 8:
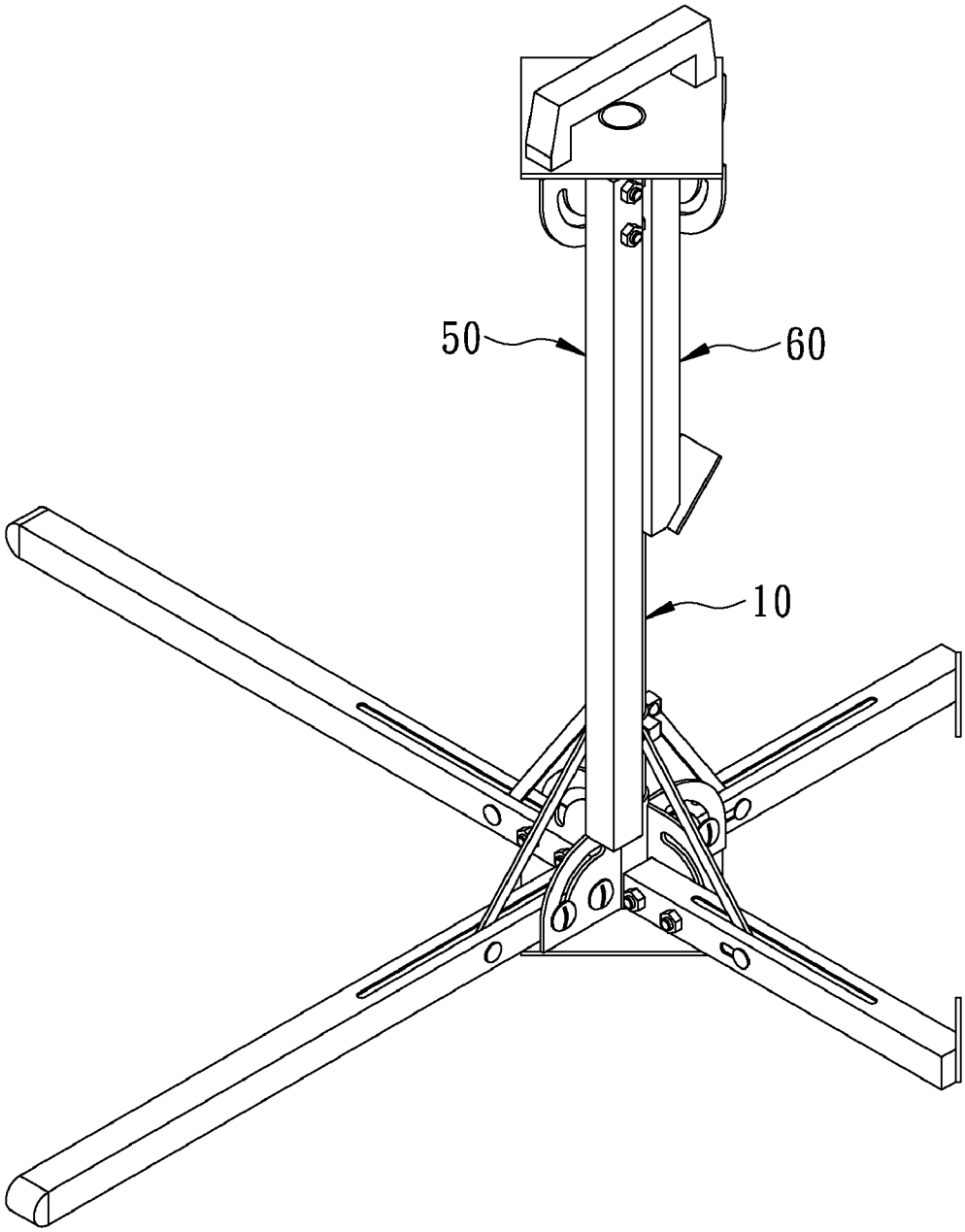
FIG. 8 is a schematic operational view of the foldable stand shown in FIG. 1, showing one pair of legs and one pair of support bars moved toward, and aligned against, the main shaft.
Figure 10:
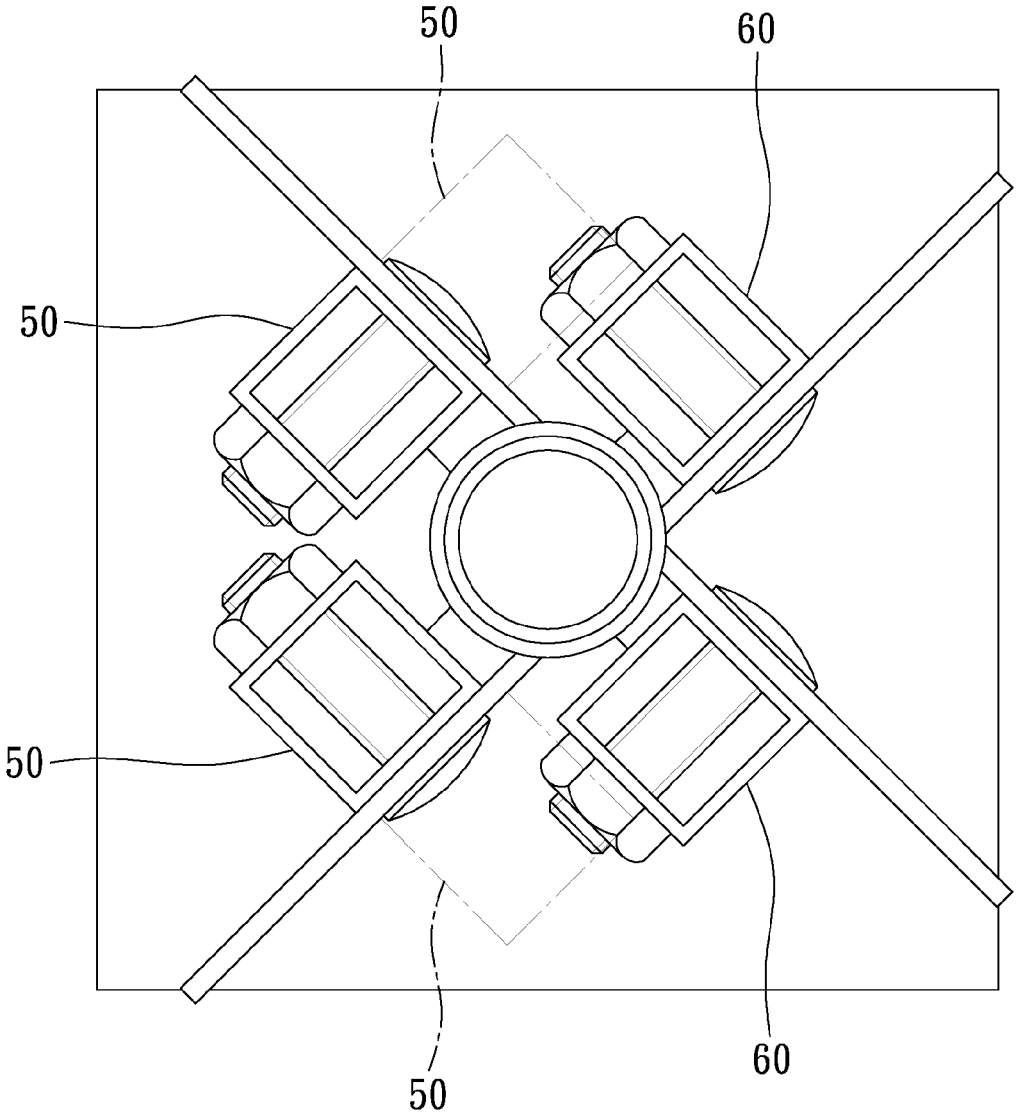
FIG. 10 is a sectional view taken along line X-X of FIG. 9.
Figure 11:
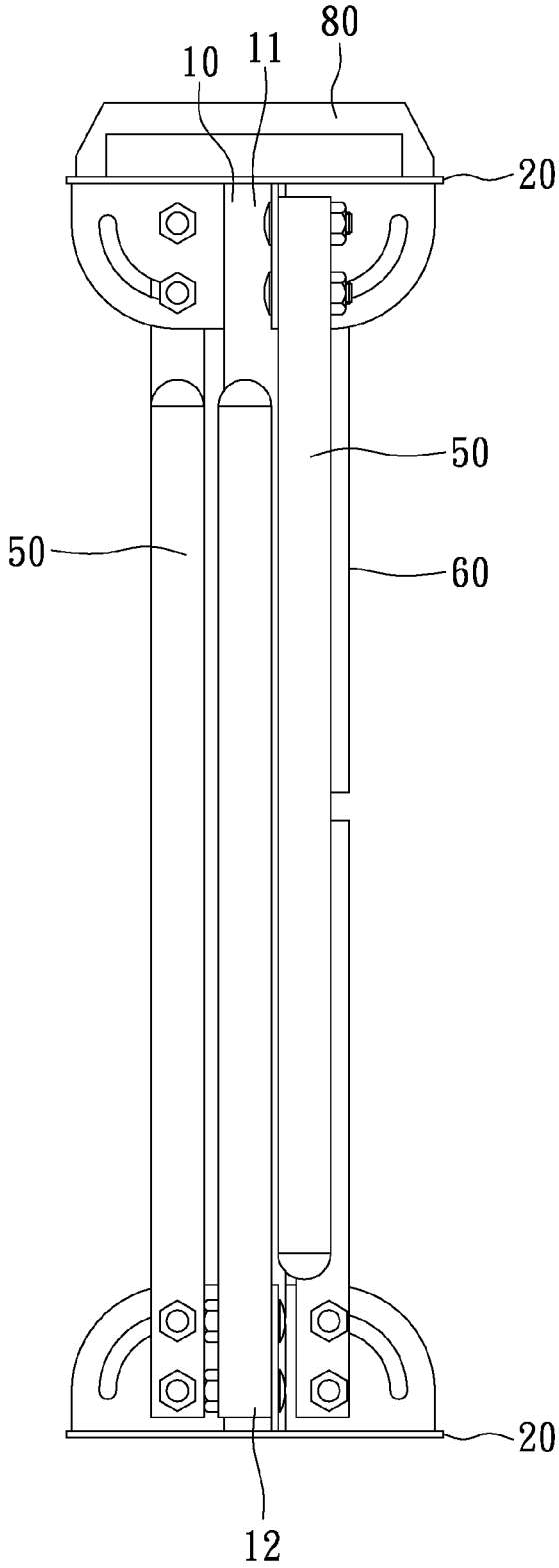
FIG. 11 corresponds to FIG. 9 when viewed from another angle.

When one leg 50 or support bar 60 is rotated about the associated fastening member 53 or 63 after removal of the machine tool from the positioning members 90, as indicated by the imaginary line in FIGS. 6 and 7, the associated second fastening member 54 or 64 is moved from the associated first positioning portion 32 or 42 along the associated guide slot 34 or 44 toward the associated second positioning portion 33 or 43 and to move the first links 72 or second links 73 of the associated linkage 70. At the same time, the first locating pin 100 or second locating pin 110 is pressed down to enable the sleeve 71 of the associated linkage 70 to move past the first locating pin 100 or second locating pin 110 toward the middle part 13 of the main shaft 10. Thereafter, the respective pair of legs 50 or support bars 60 are closely aligned along the main shaft 10 in the collapsed position as shown in FIG. 8. Further, because the mounting positions of the legs 50 corresponding to the first and second ends 11 and 12 of the main shaft 10 are retained in a staggered manner (see the solid line and imaginary line in FIG. 10 and see also FIG. 11), the length of two support bars 60 in the axially aligned status is less than the length of one leg 50, and therefore the legs 50 are closely aligned along the main shaft 10 without interference and, the support bars 60 that are connected to the first end 11 of the main shaft 10 are respectively maintained in axial alignment with the support bars 60 that are connected to the second end 12 of the main shaft 10. It is noted that only one pair of support bars 60 are seen in the right side in FIG. 10.

Figure 9:
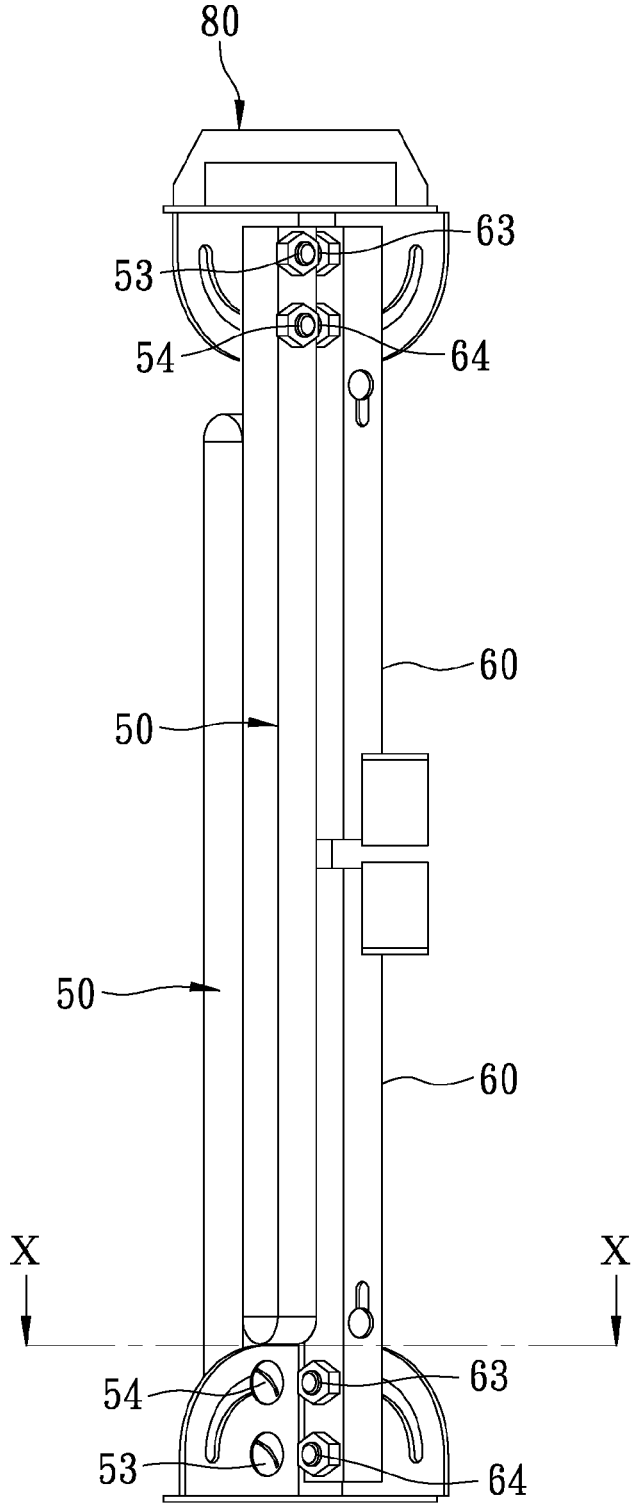
FIG. 9 is a schematic drawing of the foldable stand shown in FIG. 1, showing the collapsed status of the foldable tool stand.

Further, as indicated by the solid line in FIGS. 6 and 7, when the legs 50 and the support bars 60 are in the extended supporting position, the sleeves 71 of the linkages 70 are respectively engaged by the first locating pin 100 and the second locating pin 110 and are prohibited from moving toward the middle part 13 of the main shaft 10, assuring positive positioning. Further, when collapsing the foldable tool stand, as indicated by the imaginary lines in FIGS. 6 and FIG. 7, pressing down the first locating pin 100 and the second locating pin 110 enables the sleeves 71 of the linkages 70 to be moved towards the middle part 13 of the main shaft 10, and then any leg 50 or support bar 60 can be moved to force all the legs 50 and support bars 60 toward the main shaft 10 as shown in FIG. 9. When the legs 50 and the support bars 60 are collapsed and closely aligned along the main shaft 10, the sleeves 71 of the linkages 70 are respectively engaged by the third locating pin 120 and the fourth locating pin 130. The third locating pin 120 is disposed between the first end and the middle part, while the fourth locating pin 130 is disposed between the second end and the middle part for maintaining the sleeves in place to hold the legs and support bars in the collapsed position. This prohibits the legs 50 and support bars 60 from moving toward the first end 11 and second end 12 of the main shaft 10, and therefore the legs 50 and the support bars 60 of the collapsed foldable tool stand will not accidentally extend when carried by handle 80.

When compared to conventional tool stands, the user can easily operate the second fastening members 54 and 64 and pull the sleeves 71 of the linkages 70 to force the first links 72 and the second links 73 to move the legs 50 and the support bars 60 toward or apart from the main shaft 10. Thus, the operation of the foldable tool stand is quite simple. It requires less time and labor to extend and collapse the foldable tool stand. When collapsed, the collapsed parts of the foldable tool stand are positively maintained in the collapsed position. By means of utilizing the handle 80, the user can conveniently carry the foldable tool stand in the collapsed configuration. Further, the collapsed foldable tool stand has a small volume (see FIG. 9), thus facilitating delivery and storage.

Figure 12:
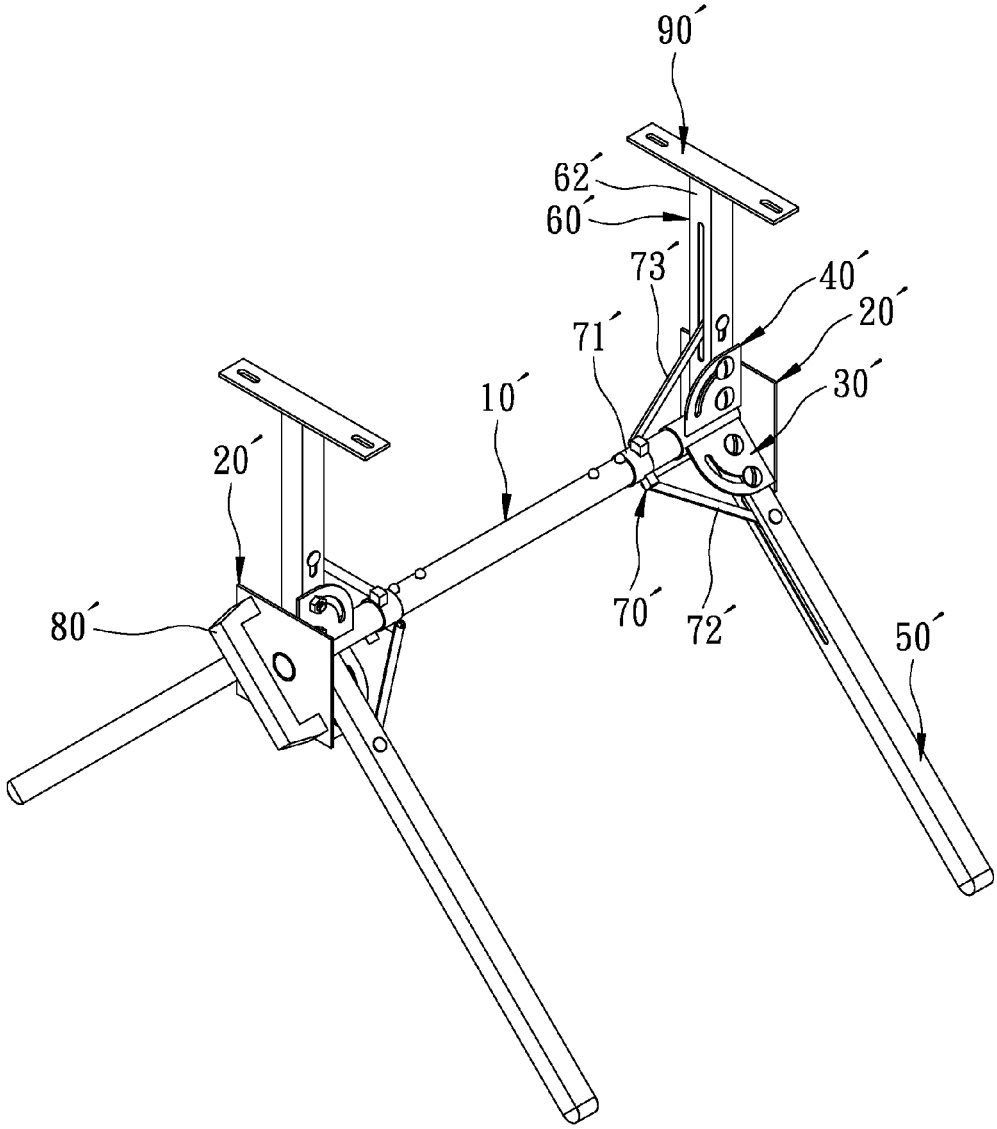
FIG. 12 is an elevational assembly view of a foldable tool stand in accordance with a second embodiment of the present disclosure.

FIG. 12 illustrates a foldable tool stand in accordance with a second embodiment of the present disclosure. Substantially similar to the aforesaid first embodiment, the foldable tool stand according to this second embodiment also includes a main shaft 10', a pair of base plates 20' affixed to the main shaft 10', two pairs of first pivot plates 30' respectively affixed to the base plates 20', at least one pair of second pivot plates 40' affixed to the base plates 20' corresponding to the first pivot plates 30'. Two pairs of legs 50' are respectively pivotally connected to the first pivot plates 30', and at least one pair of support bars 60' are respectively pivotally connected to the second pivot plates 40'. A pair of linkages 70' is coupled between the main shaft 10' and the legs 50' and support bars 60', and a handle 80' is provided. Each linkage 70' includes a sleeve 71' arranged on and movable along the length of the main shaft 10'. Each linkage 70' also includes a pair of first links 72' respectively pivotally connected between the sleeve 71' and one pair of legs 50' and a pair of second links 73' respectively pivotally connected between the sleeve 71' and at least one support bar 60'. Further, by means of reducing the number of the support bars 60' and increasing the size of the positioning members 90' at the distal ends 62' of the support bars 60', the foldable tool stand is practical for holding a small machine tool.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A foldable tool stand, comprising:

a main shaft having a first end and a second end opposed to said first end;

a positioning member located on each of said first end and said second end for supporting a machine tool;

a pair of base plates respectively affixed to the first end and second end of said main shaft; and at least two pairs of legs having a connection end and a stop end opposed to said connection end, wherein the legs are movable between a standing position having the connection ends connected to said base plates and the stop ends spaced from said main shaft and a collapsed position where said legs are closely aligned along said main shaft;

two pairs of support bars connected between said base plates and said positioning members, having a fixed end and a distal end opposed to said fixed end, wherein the support bars are movable between a first standing position having the fixed ends connected to said base plates and said distal ends are spaced from said main shaft and a second collapsed position where said support bars are closely aligned along said main shaft;

two pairs of first pivot plates disposed corresponding to said first end and said second end of said main shaft and respectively affixed to said base plates;

two pairs of second pivot plates disposed corresponding to said first end and said second end of said main shaft and respectively affixed to said base plates opposite to said first pivot plates;

a plurality of first fastening members; and a plurality of second fastening members, wherein at least one said first fastening members and at least one said second fastening members fasten said connection ends to said first pivot plates when said legs are in the standing position, and at least one different said first fastening members and at least one different said second fastening members fasten said fixed ends to said second pivot plates when said support bars are in the standing position.

2. The foldable tool stand as claimed in claim 1, wherein said first pivot plates and said second pivot plates each comprise a pivot portion disposed adjacent to said main shaft, a first positioning portion disposed at one side relative to said pivot portion and a second positioning portion disposed at a second side relative to said pivot portion and adjacent to said main shaft;

said legs having a first rotation portion located on the connection end and a first locating portion disposed closest to the main shaft having a standing and collapsed position, wherein the standing position has said first rotation portion coupled to the pivot portion and said first locating portion coupled in the first positioning portion of the associated first pivot plate , and wherein the collapsed position has said first rotation portion coupled in the pivot portion and said first locating portion coupled in the second positioning portion of the associated first pivot plate;

said support bars comprising a second rotation portion located on the fixed end and a second locating portion disposed at an inner side relative to said second rotation portion having a standing and collapsed position, wherein the standing position has said second rotation portion coupled to the pivot portion and said second locating portion coupled in the first positioning portion of said second pivot plate, and wherein the collapsed position has said second rotation portion coupled to the pivot portion and said second locating portion coupled in the second positioning portion of said second pivot plate.

3. The foldable tool stand as claimed in claim 2, wherein each said first pivot plate and said second pivot plate further comprises a guide slot connected between the first positioning portion and second positioning portion thereof in a quarter arc shape based on the center of rotation at the pivot portion.

4. The foldable tool stand as claimed in claim 3, further comprising a pair of linkages having a sleeve arranged on and movable along the length of said main shaft; a pair of first links pivotally connected between said sleeve and one pair of said legs; and a pair of second links pivotally connected between said sleeve and one pair of said support bars, wherein said legs and said support bars synchronously move toward or away from said main shaft when said sleeves are moved forwards or backwards along said main shaft; wherein said main shaft comprises a first locating pin and a second locating pin respectively arranged at the first end and second end thereof for respectively engaging said sleeves to maintain said legs and said support bars in the respective standing position.

5. The foldable tool stand as claimed in claim 4, wherein said main shaft further comprises a third locating pin disposed between said first end and a middle part thereof; and a fourth locating pin disposed between said second end and said middle part for selectively engaging said sleeves in place to maintain said legs and said support bars in the collapsed position.

6. The foldable tool stand as claimed in claim 5, further comprising a handle affixed to one said base plate.

7. The foldable tool stand as claimed in claim 1, further comprising a handle affixed to one said base plate.

8. A foldable tool stand, comprising:

a main shaft, having a first end and a second end opposed to said first end;

a positioning member located on each of said first end and said second end for supporting a machine tool;

a pair of base plates respectively affixed to the first end and second end of said main shaft;

at least two pairs of legs having a connection end and a stop end opposed to said connection end, wherein the legs are movable between a standing position having the connection ends connected to said base plates and the stop ends spaced from said main shaft and a collapsed position where said legs are closely aligned along said main shaft; and at least one pair of support bars respectively connected between said base plates and said positioning members having a fixed end and a distal end opposed to said fixed end, wherein the support bars are movable between a standing position having said fixed ends connected to said base plates and said distal ends are spaced from said main shaft and a collapsed position where said support bars are closely aligned along to said main shaft;

two pairs of first pivot plates disposed corresponding to said first end and said second end of said main shaft and affixed to said base plates, at least one pair of second pivot plates disposed corresponding to said first end and said second end of said main shaft and respectively affixed to said base plates opposite to said first pivot plates;

a plurality of first fastening members; and a plurality of second fastening members, wherein said first fastening members and said second fastening members fasten said connection ends to said first pivot plates when said legs are in the standing position, and said first fastening members and said second fastening members fasten said fixed ends to said second pivot plates when said support bars are in the standing position.

9. The foldable tool stand as claimed in claim 8, wherein said first pivot plates and said second pivot plates each comprise a pivot portion disposed adjacent to said main shaft, a first positioning portion disposed at one side relative to said pivot portion and a second positioning portion disposed at a second side relative to said pivot portion and adjacent to said main shaft;

said legs having a first rotation portion located on the connection end and a first locating portion disposed closest to the main shaft having a standing and collapsed position, wherein the standing position has said first rotation portion coupled to the pivot portion and said first locating portion coupled in the first positioning portion of the associated first pivot plate , and wherein the collapsed position has said first rotation portion coupled to the pivot portion and said first locating portion coupled in the second positioning portion of the associated first pivot plate ;

said support bars comprising a second rotation portion located on the fixed end and a second locating portion disposed at an inner side relative to said second rotation portion having a standing and collapsed position, wherein the standing position has said second rotation portion coupled to the pivot portion and said second locating portion coupled in the first positioning portion of one said second pivot plate , and wherein the collapsed position has said second rotation portion coupled to the pivot portion and said second locating portion coupled in the second positioning portion of said second pivot plate.

10. The foldable tool stand as claimed in claim 9, wherein each said first pivot plate and said second pivot plate further comprises a guide slot connected between the first positioning portion and second positioning portion thereof in a quarter arc shape based on the center of rotation at the pivot portion.

11. The foldable tool stand as claimed in claim 10, further comprising a pair of linkages having a sleeve arranged on and movable along the length of said main shaft, a pair of first links pivotally connected between said sleeve and one pair of said legs; and at least one second link pivotally connected between said sleeve and one pair of said support bars, wherein said legs and said support bars synchronously move toward or away from said main shaft when said sleeves are moved forwards or backwards along said main shaft; wherein said main shaft comprises a first locating pin and a second locating pin respectively arranged at the first end and second end thereof for selectively engaging said sleeves to maintain said legs and said support bars in the respective standing position.

12. The foldable tool stand as claimed in claim 11, wherein said main shaft further comprises a third locating pin disposed between said first end and a middle part thereof; and a fourth locating pin disposed between said second end and said middle part for selectively engaging said sleeves in place to maintain said legs and said support bars in the collapsed position.

13. The foldable tool stand as claimed in claim 12, further comprising a handle affixed to one said base plate.

* * * * *